US009115965B2

(12) United States Patent
Alculumbre

(10) Patent No.: US 9,115,965 B2
(45) Date of Patent: Aug. 25, 2015

(54) PROJECTILE

(76) Inventor: Michael Alculumbre, London (GB)

( * ) Notice: Subject to any disclaimer, the term of this patent is extended or adjusted under 35 U.S.C. 154(b) by 0 days.

(21) Appl. No.: 13/233,620

(22) Filed: Sep. 15, 2011

(65) Prior Publication Data

US 2013/0056578 A1 Mar. 7, 2013

(30) Foreign Application Priority Data

Sep. 5, 2011 (GB) ..... 1115302.0

(51) Int. Cl.
*F42B 10/16* (2006.01)

(52) U.S. Cl.
CPC ..... *F42B 10/16* (2013.01)

(58) Field of Classification Search
USPC ..... 244/2.24, 3.27, 3.28, 3.29
See application file for complete search history.

(56) References Cited

U.S. PATENT DOCUMENTS

| | | | | |
|---|---|---|---|---|
| 2,421,752 | A * | 6/1947 | Jones | 102/376 |
| 3,588,004 | A * | 6/1971 | Suter | 244/3.27 |
| 4,607,810 | A * | 8/1986 | Frazer | 244/3.29 |
| 4,817,891 | A * | 4/1989 | Gaywood | 244/3.23 |
| 5,189,250 | A * | 2/1993 | Shaphyr | 102/439 |
| 7,004,425 | B2 * | 2/2006 | Okada et al. | 244/3.29 |
| 8,367,993 | B2 * | 2/2013 | Velez et al. | 244/3.28 |
| 2004/0217227 | A1 * | 11/2004 | Alculumbre et al. | 244/3.28 |
| 2012/0048993 | A1 * | 3/2012 | Velez | 244/3.28 |
| 2012/0091256 | A1 * | 4/2012 | Alculumbre | 244/3.29 |

FOREIGN PATENT DOCUMENTS

WO 02/090870 A1 11/2002

* cited by examiner

*Primary Examiner* — Justin Benedik
(74) *Attorney, Agent, or Firm* — Studebaker & Brackett PC

(57) ABSTRACT

A projectile (1) for a small arms weapon. The projectile (1) comprises a projectile body (3) and a plurality of external peripheral fins (2) pivotable from a radially un-deployed position to a radially deployed position. When in the radially deployed position, each fin (2) is moveable in longitudinal direction into an engaged position with the projectile body (3) for radially securing the fin (2).

14 Claims, 3 Drawing Sheets

PROJECTILE

The present invention relates to a projectile for a small arms weapon having a barrel, such as a shotgun, and in particular a projectile having an improved fin configuration.

Projectiles for a small arms weapon, which have stabilising fins are known in the art. For example, WO 02/090870 describes a known projectile having deployable fins. When such a projectile leaves the barrel of the weapon, the external peripheral fins deploy from a radially inward position to a radially outward position to provide stability of the projectile during flight.

In this regard, such finned projectiles are known to offer a high level of accuracy over a given range, which has been attributed to their stability during flight as a result of the fins. However, testing has shown that the improvements in accuracy are not always consistent. Moreover, there is always a need for increased accuracy over longer ranges.

High speed wind tunnel analysis of projectiles by the present applicant has shown that variations in accuracies may be caused by a partial retraction of the deployable fins under aerodynamic loads. In this respect, after firing, projectiles can often adopt a non-zero angle of attack during flight. That is, a projectile's longitudinal axis will often become tilted with respect to its direction of travel. This occurs to varying degrees and may be caused, for example, by minor variations in the distribution of the propellant charge, the weight distribution along the projectile body, or environmental factors. In any case, at non-zero angles of attack, analysis has shown that the fins on the windward surface can partially retract, and in some extreme cases these fins may be pushed back into their un-deployed position. This effect is demonstrated in FIG. 5, which shows schlieren images comparing a conventional finned projectile under (a) stationary air flow conditions and (b) Mach 0.7 air flow conditions at a 10 degree angle of attack. As can be seen from FIG. 5(*b*), both fins on the windward (lower) surface have partially retracted.

Fin retraction during flight decreases the effective size of the fin and introduces asymmetries in the projectile=s aerodynamic characteristics, which can compromise the projectile's accuracy. Furthermore, analysis has also indicated that this response is inconsistent between different fins as a result of variances in the stiffness of the fin deployment springs. As a consequence, there is a degree of variability of in the deployment behavior of each fin depending upon the projectile's airspeed, its angle of attack, each fin's orientation, and fluctuations in the stiffness of each fin's deployment spring. This reduces accuracy and consistency between different individual projectiles.

The present invention seeks to overcome the above problems associated with the prior art and provide a projectile having improved accuracy.

According to an aspect of the present invention there is provided a projectile for a small arms weapon having a barrel, the projectile comprising:— a projectile body;

a plurality of external peripheral fins pivotable from a radially un-deployed position to a radially deployed position;

wherein, when in the radially deployed position, each fin is moveable in a longitudinal direction into an engaged position with the projectile body for radially securing the fin.

With this arrangement, each fin is able to move both radially and longitudinally. As such, on release from the barrel, the fins are able to pivot to a radially deployed position and then move along the longitudinal axis of the projectile into an engaged or locked position. This longitudinal movement allows each fin to move into engagement with the projectile body across a portion of its circumference. That is, engagement can be achieved across a width of each fin forming at least two points of contact with the projectile body that are circumferentially offset about the longitudinal axis of the projectile. This radially secures the fins so that they are prevented from return movement or retraction toward the un-deployed position. This effectively locks the fins in place and prevents them from being pushed back toward their un-deployed position under aerodynamic loads in flight, even if the projectile has a non-zero angle of attack. This maintains aerodynamic symmetry and therefore allows for improved accuracy and consistency.

Preferably, the projectile further comprises biasing means for biasing the fins toward their radially deployed position. In this way, the fins automatically move toward their deployed position as soon as the projectile is released from the weapon's barrel after firing.

Preferably, the projectile further comprises biasing means for biasing the fins in the longitudinal direction toward the engaged position. In this way, the fins automatically move toward their engaged position once deployed. The longitudinal direction biasing means may be the same as the radial direction biasing means.

Preferably, the biasing means comprises a spring. In this way, the spring or springs can apply radial and/or longitudinal forces to each of the fins to effect their deployment.

Preferably, at least one of the projectile body and the plurality of fins is provided with an engagement formation for engaging with the other of the projectile body and the plurality of fins when in the engaged position. In this way, the projectile body and the plurality of fins are configured to engage with one another to secure each fin in its radially deployed position.

Preferably, the engagement formation comprises a mating surface for mating with an opposing surface on the projectile body or the plurality of fins. In this way, each fin mates with the projectile body over a portion of its circumference. This acts to radially lock the fin relative to the projectile body, thereby preventing retraction of the fin and achieving better consistency during flight.

Preferably, the engagement formation is curved with the profile of the projectile for inter-engagement therewith.

Preferably, each fin is moveable in a rearward direction into the engaged position. Consequently, each fin moves or slides backwardly toward the rear of the projectile with the momentum of the projectile's movement when fired.

Preferably, the projectile body further comprises a plurality of couplings for coupling each fin thereto, each coupling comprising a pin mounted through a channel formed in the associated fin and about which the fin is pivotable. In this way, the fins are pivotably attached to the projectile body and biasing means may be provided and supported on the coupling pins. This offers a simple and reliable construction.

Preferably, each fin is slidable along its respective coupling pin for movement into its engaged position. In this way, each fin can pivot and slide along its pin, resulting in a simple and reliable coupling.

Preferably, prior to the weapon firing, the fins are held in place by a cartridge. In this way, the fins are held in their un-deployed position prior to firing.

According to a further aspect of the present invention, there is provided a projectile for a small arms weapon having a plurality of radially deployable fins, wherein once deployed, the fins are moveable rearwardly into a locked position for preventing further radial movement of the fins.

Preferably, in the locked position, at least two points of contact are formed between each fin and the projectile body, the at least two points of contact being circumferentially offset about the longitudinal axis of the projectile.

The invention will now be described, by way of illustration only, with reference to the accompanying drawings in which.

Figure 2:
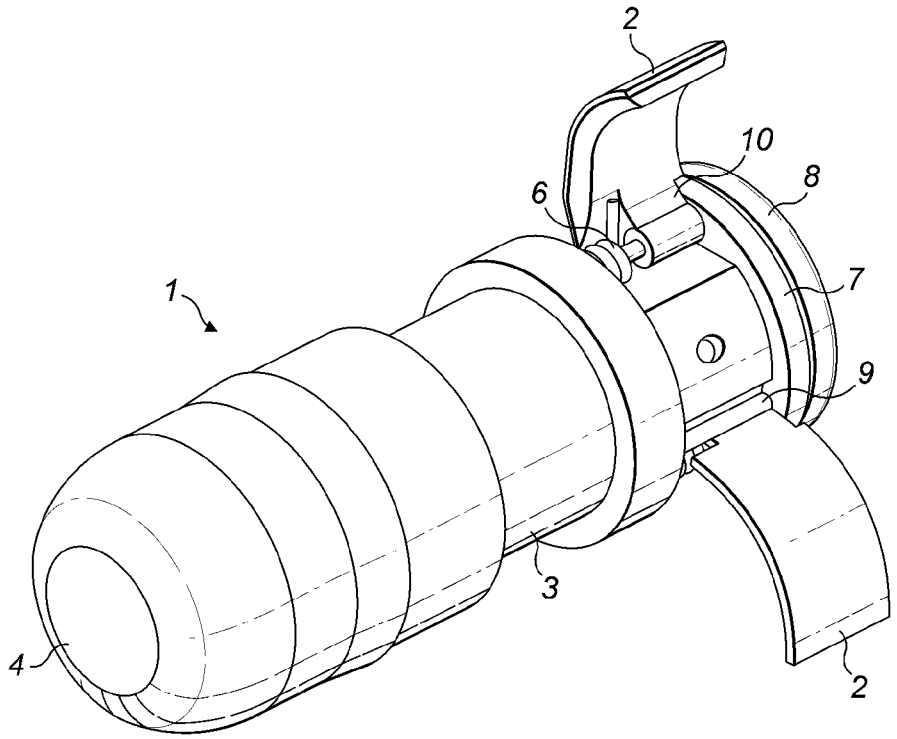
FIG. 2 shows a perspective view of the projectile shown in FIG. 1.
Figure 3:
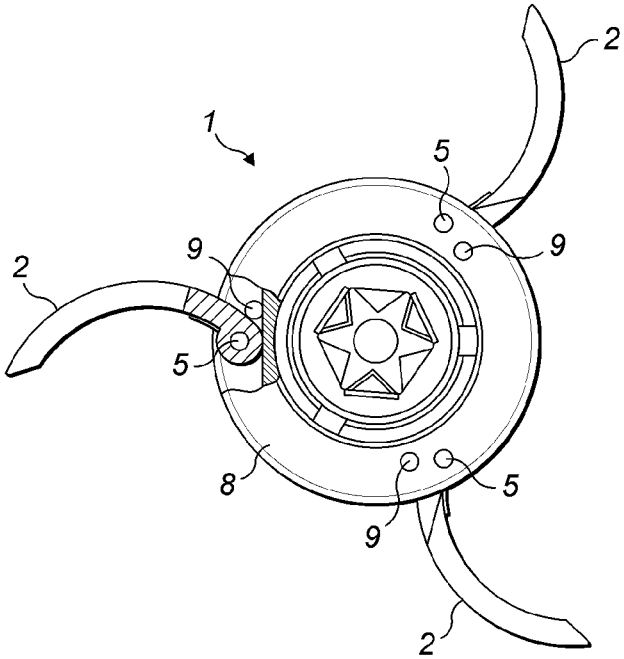
FIG. 3 shows a rear cross-sectional view of the projectile shown in FIG. 1.
Figure 4:
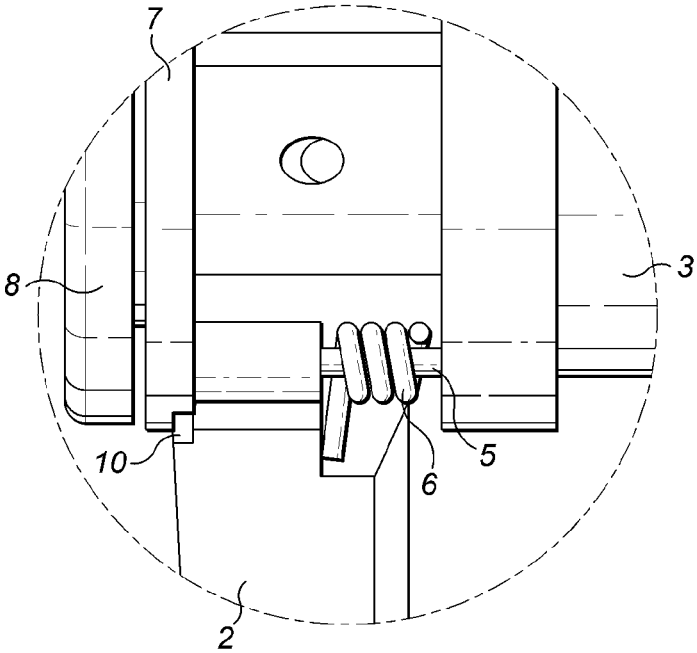
FIG. 4 shows an enlarged view of the rear area of the projectile shown in FIG. 1.
Figure 5A:
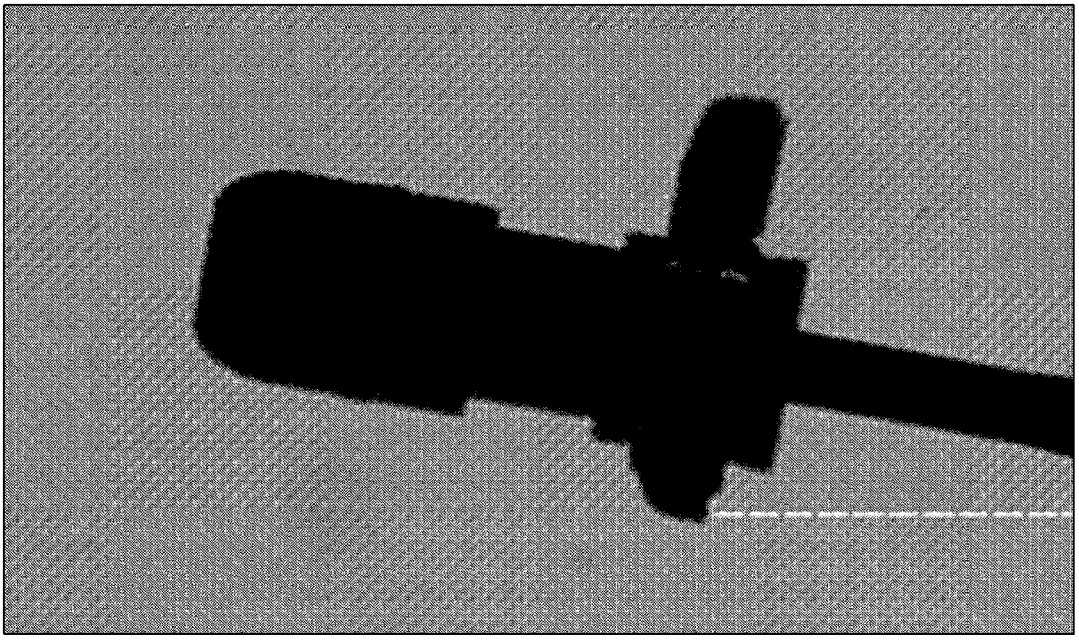
FIG. 5 shows schlieren images of a conventional finned projectile under (a) stationary air flow conditions and (b) Mach 0.7 air flow conditions at a 10 degree angle of attack.
Figure 5B:
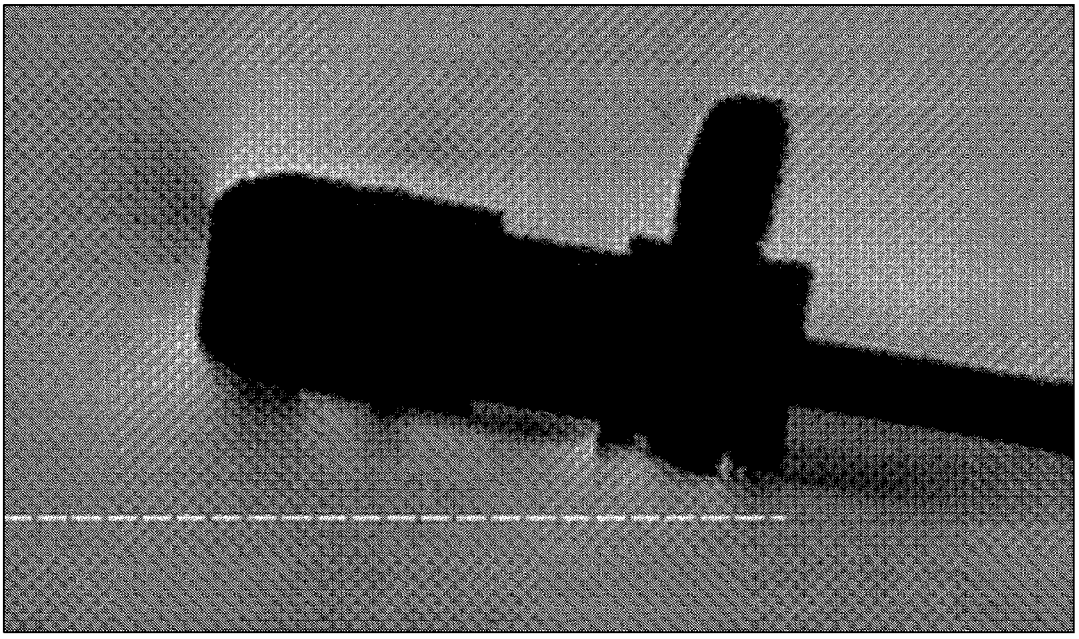

FIGS. 1 to 4 show a projectile 1 according to an embodiment of the invention. The projectile 1 has a body 3 comprising of a front section 4, containing the warhead, and a rear section 8. The rear section 8 includes mounting formations 7, which support coupling pins 5, onto which three fins 2 are pivotably provided. Fin deployment springs 6 are provided on coupling pins 5, with one end of each spring engaging the projectile body 3 and the other end received by a formation provided at the base of its respective fin 2. The springs 6 act to bias the fins 2 radially outward to a deployed position, with the ends of the spring applying a radial force between the projectile body and the fin. The springs 6 are also configured to bias the fins 2 rearwardly along the longitudinal axis of the projectile. As shown in FIG. 4, this is achieved by each spring 6 applying a rearward force to its fin 2 through the formation at the fin's base.

Figure 1:
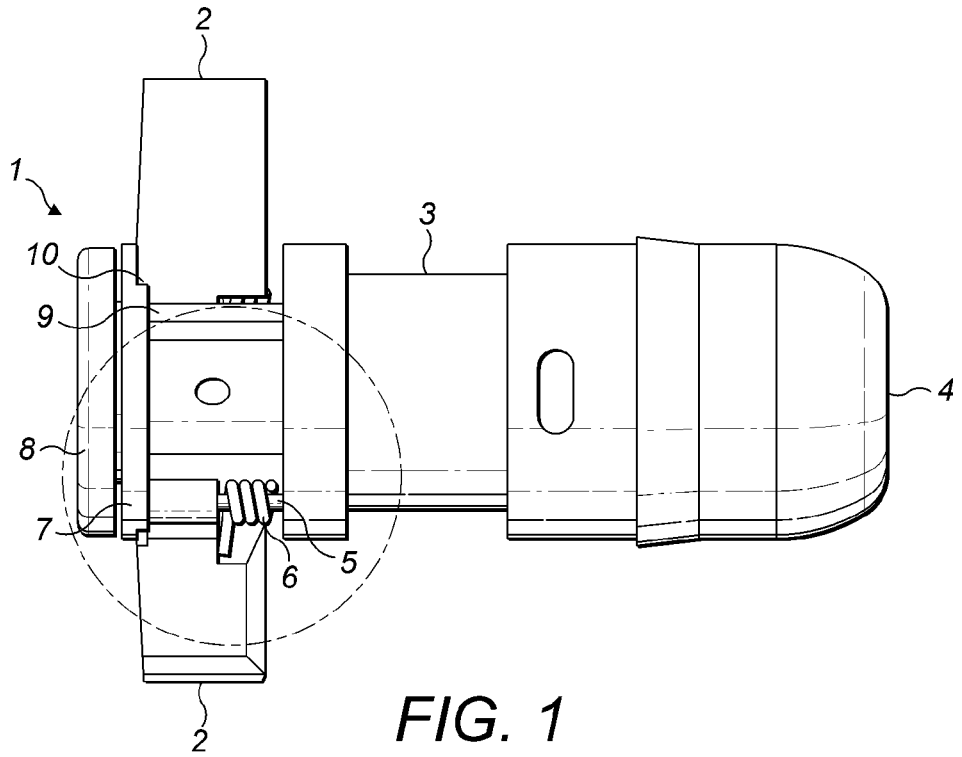
FIG. 1 shows a side view of a projectile according to an embodiment of the invention, with the fins shown in a deployed position.

As can be seen in FIGS. 1, 2, and 4 the mountings 7 at the rear section 8 of the projectile body 3 form a channel around the circumference of the projectile body 3 into which fins 2 are received when in the un-deployed position. In this state the projectile 1 is sized to fit within the bore of a small arms weapon's barrel.

As shown in FIG. 3, the mountings 7 at the rear section 8 of the projectile body 3 also support stopping pins 9, which prevent the fins 2 from rotating beyond their deployed position.

FIG. 4 shows an enlarged view of the circled section shown in FIG. 1. At the base of each fin 2 is provided a coupling channel or bore through which a coupling pin 5 extends. This provides a coupling whereby each fin 2 is able to rotate about and slide along its respective coupling pin 5. As discussed above, at the same time, spring 6 is configured to engage with each fin 2 and apply both radial and longitudinal forces for biasing each fin 2 outward and rearward.

FIG. 4 also shows notch 10 provided across the width of each fin 2, at its rear and adjacent to its base. The notch 10 is configured to fit over and mate with the rear rim of mounting 7 of the projectile body.

In use, projectile 1 is initially enclosed within a cartridge which holds the fins 2 in their un-deployed position and houses the propellant charge at the rear of the projectile. When the weapon is fired, the propellant charge propels the projectile from its cartridge and along the weapon's barrel. When the projectile emerges from the weapon's barrel, the fins 2 are released, and the radially outward and longitudinally rearward bias of the springs 6 act to move them. Initially, the fins are prevented from lateral movement as the rear edge of the fin 2 is biased against the rear rim of mountings 7. However, the radially outward bias acts to rotate each fin out to its deployed position. Once in this position, the back of the fin 2 contacts its stopping pin 9, thereby preventing further rotation of the fin 2.

At the same time as the above, as the fins 2 radially move to their deployed position, notch 10 aligns with the rear rim of mounting 7, which allows each fin 2 to slide rearwardly along its coupling pin 5 under the bias of its spring 6. This acts such that notch 10 slides over the rim of mounting 7 into an engaged position, with the surfaces of these formations mating with one another.

As shown in FIG. 3, once in this engaged position, the width of each fin 2 mates with a counter surface on the rim of mounting 7. This thereby provides a circumferential support surface on the projectile body for supporting each fin 2. This circumferential support prevents further radial movement of the fins 2 in either direction by providing points of contact that are circumferentially offset about the longitudinal axis of the projectile. Once in this position, the fins 2 are effectively locked in their deployed position since they are biased rearwardly into this engaged position.

Accordingly, with the above described arrangement, once deployed, the fins 2 are locked into position and prevented from retracting. As such, even if the projectile adopts a non-zero angle of attack, each fin remains in its deployed position, thereby maintaining consistent fin positioning and consequently symmetrical aerodynamic characteristics of the projectile. This avoids variations which may otherwise have occurred due to differences in fin orientation and fin deployment spring stiffness. This allows for better stability during flight and hence improved consistency.

It will be understood that the embodiment illustrated above shows an application of the invention only for the purposes of illustration. In practice the invention may be applied to many different configurations, the detailed embodiments being straightforward for those skilled in the art to implement.

For example, although in the above example, the fins 2 are shaped to mate with the projectile body, it will be understood that the projectile body may also or alternatively be provided with formations for mating with the fins to radially secure them. For example, slots could be provided at the rear of the projectile body into which the fins are slidably received. With such an arrangement, the slots could be aligned so as to receive the fins once they have been radially deployed.

In addition, formations provided on the projectile body 3 and/or the fins 2 could be used to guide the movement of the fins to their radially deployed and longitudinally engaged positions. For example, tapered slots could be formed at the rear of the projectile body for moving the fins gradually rearward as they move radially out to their deployed position.

Furthermore, although in the above embodiment, the projectile 1 has three fins, it will be understood that other fin configurations could also be provided.

Furthermore, in the above embodiment the fins are biased by springs. However, other biasing means are also envisaged. Moreover, the projectile's own momentum or air resistance on the fins could be used to effect the deployment of the fins.

The invention claimed is:

1. A small arms weapon projectile comprising:

a projectile body having a channel around its circumference, the channel comprising a rim;

a plurality of external peripheral fins pivotable from a radially un-deployed position to a radially deployed position, each of the plurality of fins comprising an engagement formation; and wherein, when in the radially un-deployed position, the fins are received within the channel and, when in the radially deployed position, each fin is moveable in longitudinal direction into an engaged position where its engagement formation mates with the rim of the channel to be radially secured by an engagement across a portion of the projectile body's circumference.

2. A projectile according to claim 1, further comprising biasing means for biasing the fins towards their radially deployed position.

3. A projectile according to claim 2, wherein the biasing means comprises a spring.

4. A projectile according to claim 1, further comprising a biasing means for biasing the fins in the longitudinal direction towards the engaged position.

5. The projectile according to claim 4, wherein the biasing means comprises a spring.

6. A projectile according to claim 1, wherein the projectile body is provided with an engagement formation for engagement with the plurality of fins when in the engaged position for radially securing the fins.

7. A projectile according to claim 1, wherein the engagement formation comprises a mating surface for mating with an opposing surface on the projectile body or plurality of fins.

8. A projectile according to claim 7, wherein the engagement formation is curved with the profile of the projectile for inter-engagement therewith.

9. A projectile according to claim 1, wherein each fin is moveable in a rearward direction into the engaged position.

10. A projectile according to claim 1, wherein the projectile body further comprises a plurality of couplings for coupling each fin thereto, each coupling comprising:

a pin mounted through a channel formed in the associated fin and about which the fin is pivotable.

11. A projectile according to claim 10, wherein each fin is slidable along its respective pin for movement into its engaged position.

12. A projectile according to claim 1, wherein prior to the weapon firing, the fins are held in place by a cartridge.

13. A small arms weapon projectile comprising:

a body having a channel around its circumference, the channel having a rim; and a plurality of radially deployable fins, each fin having a notch on its rear edge, wherein once deployed, the fins are moveable rearwardly into a locked position in which their notches fit over the rim of the channel and engage with respective portions of the circumference of the body for preventing further radial movement of the fins.

14. A projectile according to claim 13 wherein, in the locked position, at least two points of contact are formed between each fin and the rim of the projectile body, the at least two points of contact being circumferentially offset about the longitudinal axis of the projectile.

* * * * *